US005507495A

United States Patent [19]

Kiss

[11] Patent Number: 5,507,495

[45] Date of Patent: Apr. 16, 1996

[54] GAMES FOR TEACHING ALPHABET, NUMBERS, COLORS, SHAPES AND MATH ALONG WITH COORDINATION AND MOTOR SKILLS

[76] Inventor: Robert J. Kiss, 13268 Center Ave., Largo, Fla. 34643

[21] Appl. No.: 321,760

[22] Filed: Oct. 12, 1994

[51] Int. Cl.[6] ..... A63F 3/00

[52] U.S. Cl. ..... 273/243; 273/444; 273/286; 273/430; 434/159; 434/191

[58] Field of Search ..... 273/444, 57.1, 273/236–256, 269, 261, 286; 434/159, 191

[56] References Cited

U.S. PATENT DOCUMENTS

| | | | |
|---|---|---|---|
| 607,013 | 7/1898 | Boig | 273/248 |
| 2,769,640 | 11/1956 | Elder | 273/269 |
| 4,019,740 | 4/1977 | Ball | 273/261 |
| 4,211,419 | 7/1980 | Larsen | 273/248 |
| 5,249,808 | 10/1993 | Batte | 273/249 |

FOREIGN PATENT DOCUMENTS

| | | | |
|---|---|---|---|
| 1129581 | 10/1968 | United Kingdom | 273/249 |
| 2203355 | 10/1988 | United Kingdom | 273/243 |

*Primary Examiner*—Benjamin H. Layno

[57] ABSTRACT

Games for teaching alphabet, numbers, colors, shapes and math along with coordination and motor skills comprising a planar member having a circle at its central interior and having curves therearound to define a plurality of zones around the center. The zones have radially extending lines therethrough, at least some of which are offset from each other to define segments with indicia in the form of an alphabet, number, color, and/or shape marked in each of the segments. A plurality of indicia is correlated to the indicia of the planar member, such plurality of indicia being randomly selectable by the players.

9 Claims, 3 Drawing Sheets

GAMES FOR TEACHING ALPHABET, NUMBERS, COLORS, SHAPES AND MATH ALONG WITH COORDINATION AND MOTOR SKILLS

BACKGROUND OF THE INVENTION

1. Field of the Invention

The present invention relates to new and improved games for teaching alphabet, numbers, colors, shapes and math along with coordination and motor skills and, more particularly, pertains to teaching children of various ages important aspects of life while having them enjoy the learning experiences.

2. Description of the Prior Art

The use of children's games of a wide variety of designs and configurations is known in the prior art. More specifically, children's games of a wide variety of designs and configurations heretofore devised and utilized for the purpose of entertaining children playing games with various apparatuses and methods are known to consist basically of familiar, expected, and obvious structural configurations, notwithstanding the myriad of designs encompassed by the crowded prior art which has been developed for the fulfillment of countless objectives and requirements.

The prior art discloses a large number of children's games of a wide variety of designs and configurations. By way of example, U.S. Pat. No. 3,131,934 to Green discloses a game apparatus providing a three-dimensional game board.

U.S. Pat. No. 3,139,281 to Nicholson discloses a folding hopscotch board.

U.S. Pat. No. 3,454,279 to Foley discloses a game apparatus wherein the players constitute the game pieces.

U.S. Pat. No. 3,879,034 to Petrusek discloses a footprint alignment game.

U.S. Pat. No. 4,009,880 to Lammerson discloses a recreational device game.

U.S. Pat. No. 4,039,186 to Anderson discloses a game apparatus requiring skill, dexterity and body motion.

U.S. Pat. No. 5,102,129 to Roberts discloses a game apparatus utilizing a mat and markers.

U.S. Pat. No. 5,156,409 to Barnes discloses an active learning game with pieces for hopping onto and corresponding cards.

Lastly, U.S. Pat. No. 5,310,195 to Abdallah discloses a boardgame and method of measuring brain activity utilizing a board-game.

In this respect, the games for teaching alphabet, numbers, colors, shapes and math along with coordination and motor skills according to the present invention substantially departs from the conventional concepts and designs of the prior art, and in doing so provides an apparatus primarily developed for the purpose of teaching children of various ages important aspects of life while having them enjoy the learning experiences.

Therefore, it can be appreciated that there exists a continuing need for new and improved games for teaching alphabet, numbers, colors, shapes and math along with coordination and motor skills which can be used for teaching children of various ages important aspects of life while having them enjoy the learning experiences. In this regard, the present invention substantially fulfills this need.

SUMMARY OF THE INVENTION

In view of the foregoing disadvantages inherent in the known types of children's games of a wide variety of designs and configurations now present in the prior art, the present invention provides new and improved games for teaching alphabet, numbers, colors, shapes and math along with coordination and motor skills. As such, the general purpose of the present invention, which will be described subsequently in greater detail, is to provide new and improved games for teaching alphabet, numbers, colors, shapes and math along with coordination and motor skills and methods which have all the advantages of the prior art and none of the disadvantages.

To attain this, the present invention essentially comprises a 1. New and improved games for teaching alphabet, numbers, colors, shapes and math along with coordination and motor skills comprising, in combination, a planar member having a circle at its central interior and having a plurality of concentric rings located therearound to define a plurality of circular zones of increasing diameter when measured from the center, the zones having radially extending lines therethrough at least some of which are offset from each other in the various rings to define segments with indicia marked in each of the segments; and a deck of cards, each of the cards being provided with a first face which is blank and a second face with varying indicia thereon, the indicia of the cards being correlated to the indicia of the planar surface whereby, when a player standing in the circle picks a preselected card, such player will be required to move to a segment in response to the information on the card.

There has thus been outlined, rather broadly, the more important features of the invention in order that the detailed description thereof that follows may be better understood and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved games for teaching alphabet, numbers, colors, shapes and math along with coordination and motor skills which have all the advantages of the prior art children's games of a wide variety of designs and configurations and none of the disadvantages.

It is another object of the present invention to provide new and improved games for teaching alphabet, numbers, colors, shapes and math along with coordination and motor skills which may be easily and efficiently manufactured and marketed.

It is a further object of the present invention to provide new and improved games for teaching alphabet, numbers, colors, shapes and math along with coordination and motor skills which are of a durable and reliable construction.

A further object of the present invention is to provide an active learning game sheet of sufficient size so that a child may hop from one area to another safely, with the surfaces having sufficient coefficients of friction so that the force of the child jumping onto them does not cause the child to slip or to slide and with top surfaces being marked with letters, numbers, colors and shapes that are to be recognized by the child in a learning game.

An even further object of the present invention is to provide new and improved games for teaching alphabet, numbers, colors, shapes and math along with coordination and motor skills which are susceptible of a low cost of manufacture with regard to both materials and labor, and which accordingly are then susceptible of low prices of sale to the consuming public, thereby making such games for teaching alphabet, numbers, colors, shapes and math along with coordination and motor skills economically available to the buying public.

Still yet another object of the present invention is to provide new and improved games for teaching alphabet, numbers, colors, shapes and math along with coordination and motor skills which provide in the apparatuses and methods of the prior art some of the advantages thereof, while simultaneously overcoming some of the disadvantages normally associated therewith.

Even still another object of the present invention is to teach children of various ages important aspects of life while having them enjoy the learning experiences.

Lastly, it is an object of the present invention to provide games for teaching alphabet, numbers, colors, shapes and math along with coordination and motor skills comprising, a planar member having a circle at its central interior and having curves therearound to define a plurality of zones around the center, the zones having radially extending lines therethrough, at least some of which are offset from each other to define segments with indicia marked in each of the segments; and a plurality of indicia correlated to the indicia of the planar member, such plurality of indicia being randomly selectable by the players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
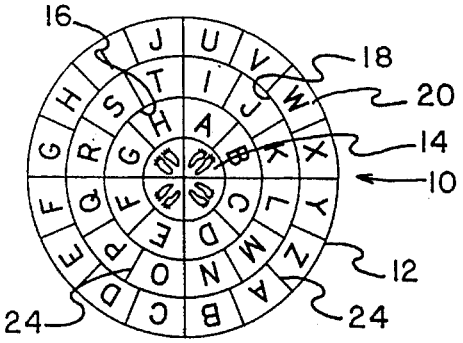
FIGS. 1 through 4 are plan views of various embodiments of the new and improved games for teaching alphabet, numbers, colors, shapes and math along with coordination and motor skills constructed in accordance with the principles of the present invention.
Figure 2:
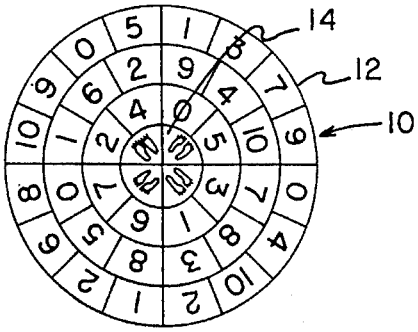
Figure 3:
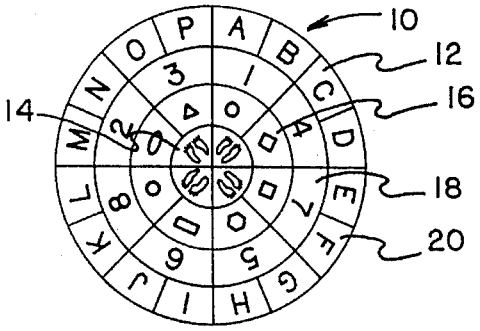
Figure 4:
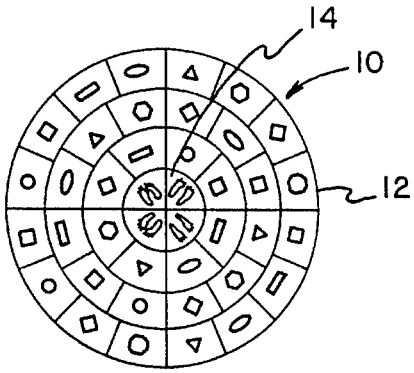
Figure 5:
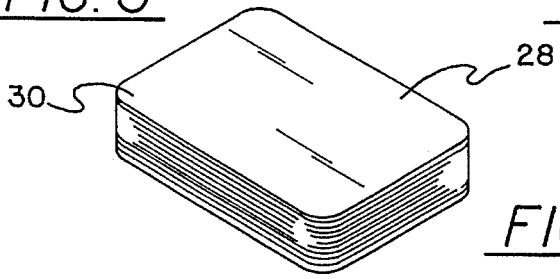
FIGS. 5 through 9 are illustrative of cards from a deck of cards utilized in association with playing the game on the mats shown on FIGS. 1 through 4.
Figure 6:
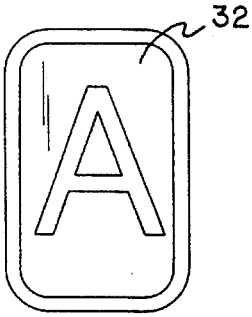
Figure 7:
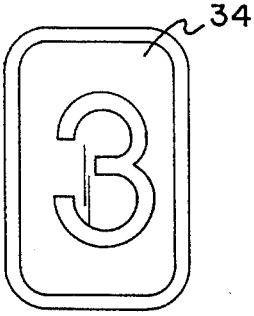
Figure 8:
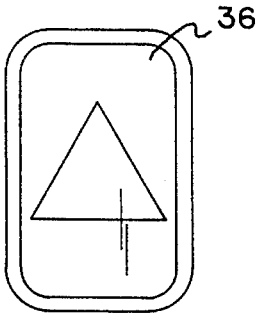
Figure 9:
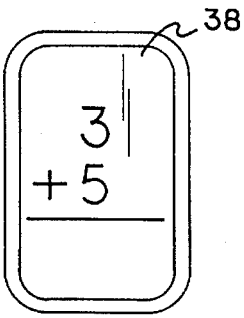
Figure 11:
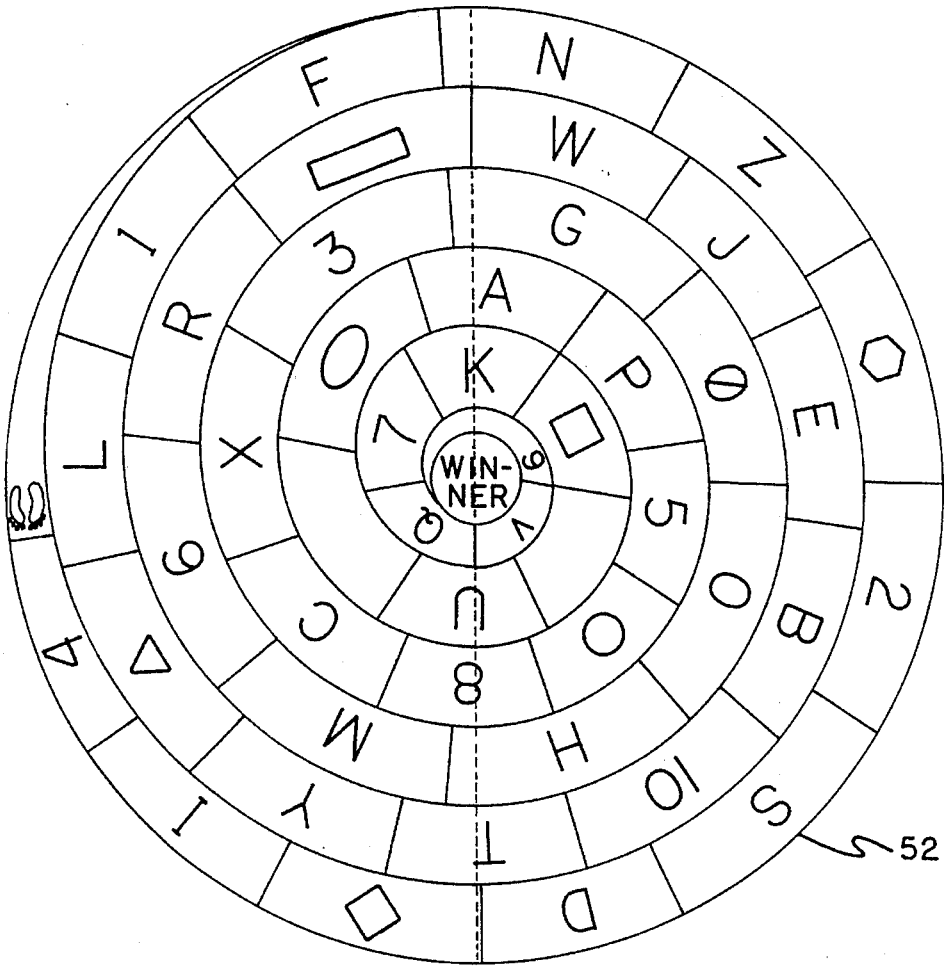
FIG. 11 is a plan view of the board shown in FIG. 10.
Figure 13:
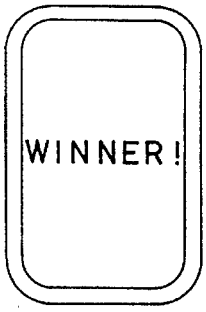
FIGS. 13 through 16 show cards used in association with the game of FIGS. 10 and 11.
Figure 14:
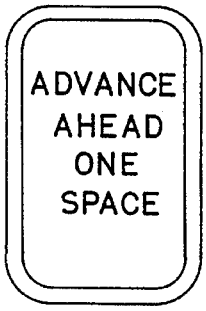
Figure 15:
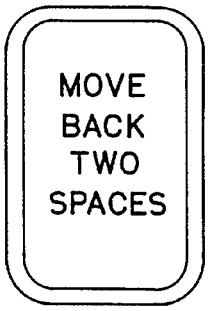
Figure 16:
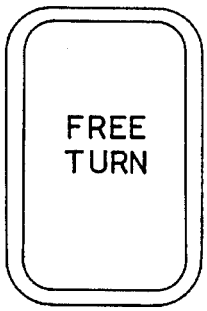
Figure 12:
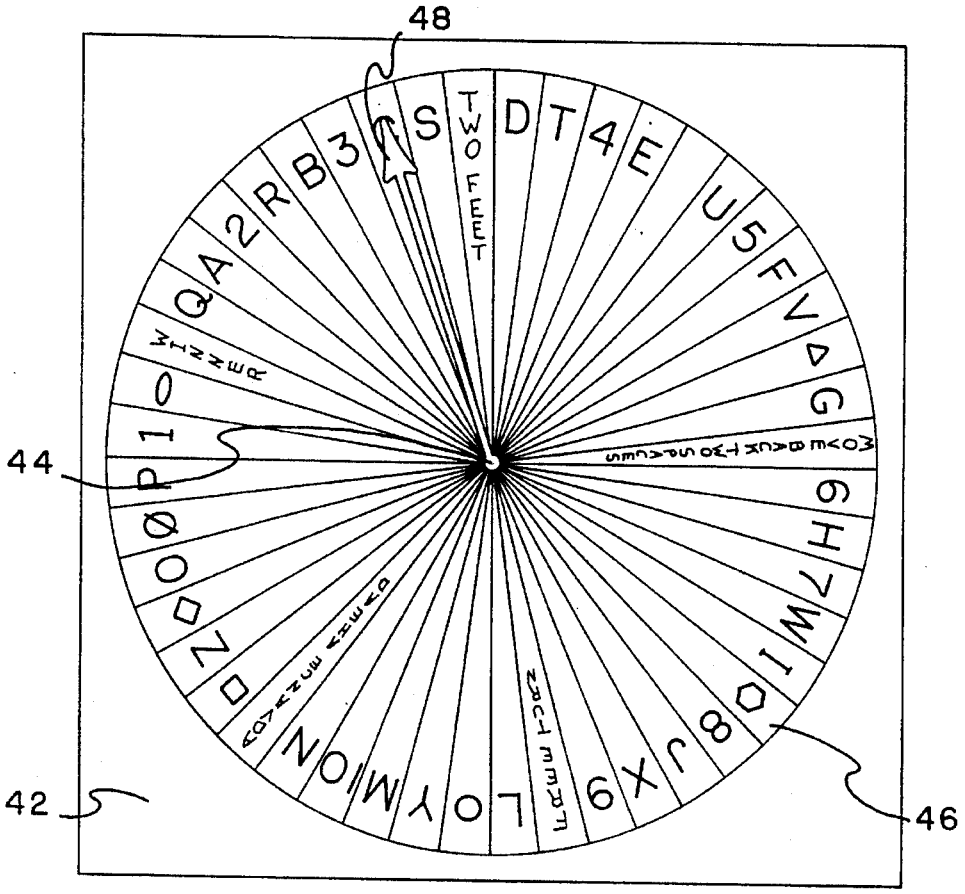
FIG. 12 shows a spinner for use in association with the board of FIGS. 10 and 11.
Figure 17:
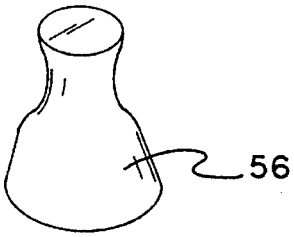
FIG. 17 show a playing piece for use in association with the board of FIGS. 10 and 11.
Figure 10:
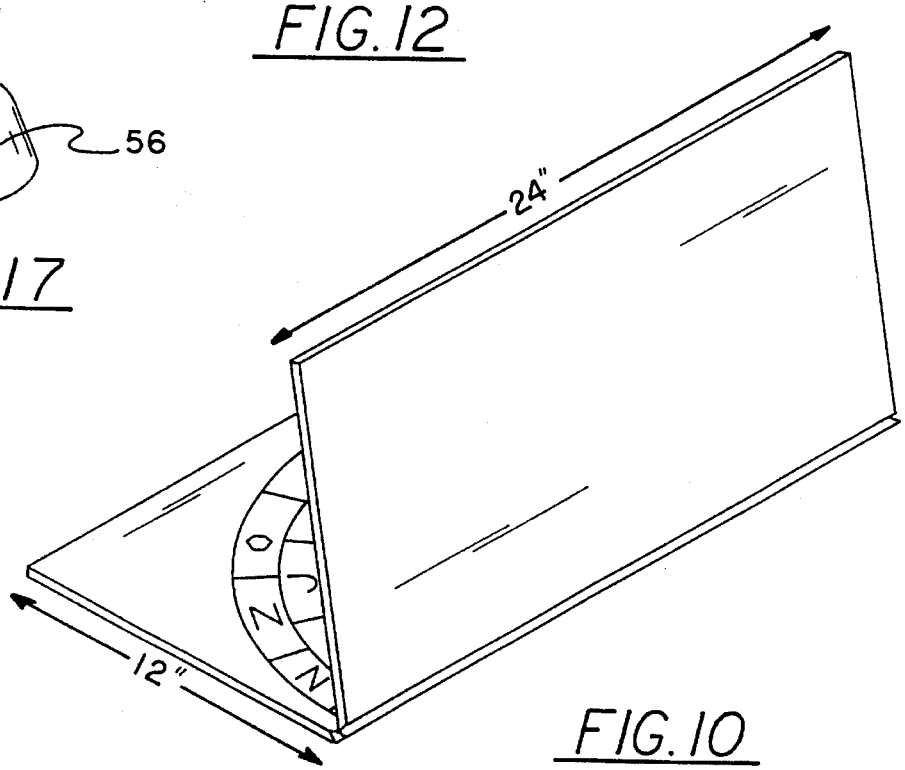
FIG. 10 is a board constructed in accordance with an alternate embodiment of the invention.

With reference now to the drawings, and in particular to FIGS. 1 through 9 thereof, there is illustrated the preferred embodiment of the new and improved games for teaching alphabet, numbers, colors, shapes and math along with coordination and motor skills embodying the principles and concepts of the present invention. The invention is a game generally designated by the reference numeral 10.

As shown in the various Figures, the primary embodiment of the present invention is a system 10 formed of a plurality of components. In their broadest context, such components simply include a planar member and a deck of cards. The components are individually configured and correlated with respect to each other for teaching the alphabet, numbers, colors, shapes and math along with coordination of motor skills.

The central component of this system 10 of the game of the present invention is a planar member 12. Such planar member has a circle 14 at its central interior. It also has a plurality of concentric rings 16, 18, 20. Such rings are located around the central circle. The rings define a plurality of circular zones of increasing diameter. Such diameter increases when measured from the center. The zones have radially extended lines 24 extending therethrough. At least some of such lines are offset from each other in the various rings. This is to define segments with indicia marked in each of the segments.

Next provided is the deck of cards 28. Each of the cards of the deck is provided with a first face 30 which is blank. The second face of each card, 32, 34, 36, 38 is provided with varying indicia thereon, one type of indicia for each card. The indicia of the cards is correlated to the indicia of the planar surface. In this manner, when a player standing in the circle picks a pre-selected card such player will be required to move to a segment of the board in response to the information on the card.

In an alternate embodiment of the invention, the board is of a reduced size to be placed upon a playing surface such as a table, the floor or the ground. The indicia is located on a spinner 42. The spinner has a center 44 with indicia 46 located around the center and extending to the external periphery. An arrow 48 is rotatable about the center of the spinner in this manner, upon rotation, the arrow will stop and point to a particular item of indicia to indicate an area of the platform where the player is to move either himself or his or her piece.

In this alternate embodiment, the player himself or herself does not move from segment to segment but, rather, each player has a playing piece 56 of a distinctive design or preferably color. It is such pieces which are moved along in accordance with information received from the playing cards. In such alternate embodiment, the curved surfaces are in the form of a spiral.

The basic concept of the present invention is to teach children ages 3 and up the basics of the alphabet, numbers, colors, shapes, and math (addition, subtraction, multiplication and division) as well as coordination and motor skills, without them even realizing they are learning, by having fun. The present invention is guaranteed to bring many hours of fun, learning and exercise for the whole family.

The present invention comes in three individual types: letters, numbers or shapes, or in a combination of the three. The letters game contains all of the letters of the alphabet with most of them duplicated at least once. The duplicated letters are of a different color than its predecessor. The numbers game contains the numbers 0 through 10 with all of them duplicated at least once. The duplicated numbers are of a different color than its predecessor. The shapes game contains basic shapes (square, rectangle, circle, oval, triangle, hexagon and octagon) with all of them duplicated at least once. The duplicated shapes are of a different color than its predecessor. The combination game combines all three games, in any combination, to include letters, numbers and shapes, but may not have any duplication of such. The object of the present invention is to jump to the selected or correct area without touching a line. If a player jumps to the wrong letter, number, shape or color, or touches a line, then he/she is out of the game. The remaining player is the winner. The game may be played by one to four players.

The present invention includes a spinner, flash cards (all games) and playing mats. To begin play with the basic game, the game mat in unfolded and laid flat on the floor or ground. All players stand in one of the areas with the feet to start the game. The youngest player goes first and continues to the oldest player.

The first player picks a card. The player must jump to whatever letter, number, shape and color is indicated on the card without touching a line or jumping to the wrong letter, number, shape or color, otherwise that player is out of the game.

Alternately, the first player may spin the spinner. The player must jump to whatever letter, number, shape or color the arrow points to without touching a line or jumping to the wrong letter, number, shape or color, otherwise that player is out of the game.

The center starting area (feet) may be used as a free space. If a player feels their selection is too far to jump to, they may jump to one of the free spaces and then to their selected space.

The next (card/spin) selection requires the player to jump from their existing space to the newly selected space. This process is continued until all players are eliminated except the last person. The last person must take his/her turn and complete the jump successfully to win. If not, the next to last player comes back into the game and they compete until there is only one person left. Again, the last person must successfully complete his turn. If he does, then he is the winner.

The math game is played with the numbers game and the rules are as follows: 1) The flash cards are shuffled. 2) All players stand in one of the areas with the feet. 3) The youngest player goes first and play continues to the oldest player. 4) Each player picks a flash card, one at a time, and must jump to the correct answer regardless of color without touching a line. If the player jumps to the wrong answer or touches a line than that player is out of the game. The center starting area (feet) may be used as a free space. If a player feels their selection is too far to jump to, he/she may jump to the center space and then to his selected space. 5) The next flash card selection requires the player to jump from his existing space to the next answer for the flash card selection. 6) The process is continued until all players are eliminated except the last person. The last person must take his turn and complete the jump successfully to win. If not, the next to last player comes back into the game and they must compete until there is only one person left. Again, the last person must successfully complete his turn. It he does, then he is the winner.

An alternate embodiment of the present invention comprises a board game. The basic concept of the board game is to teach children ages 3 and up the basics of the alphabet, numbers, colors, shapes, and math (addition, subtraction, multiplication and division) without them even realizing they are learning, by having fun. The present invention is guaranteed to bring many hours of fun, learning and exercise for the whole family.

The board game contains all of the letters of the alphabet, the numbers 0 through 10, several basic shapes (square, rectangle, circle, oval, triangle and hexagon), and several colors.

The object of the board game is to move to the correct space by matching the selected letter, shape or number and color. There are four "two feet" cards (must move back to start); two "free turn" cards (may take an extra turn); four "advance ahead one space" cards; four "move back two spaces" cards; and one "Winner" card (the first person to pick the Winner card moves to the WINNER space and wins the game. The game may be played by one to four players.

To begin playing, all pieces are removed from the box and compared to the following illustrations to ensure all parts have been received. The parts include one deck of assorted letters, numbers and shapes cards, one deck of math cards (used only for the math game), one game board and four game pieces.

The deck of assorted letters, numbers and shapes cards include the following:

Letter, Number, Shape card: Move to the letter, number, or shape space and color that is marked on the card selected.

Two Feet cards (4): Move back to START.

Free Turn card (4): Player may take another turn or may save it for later to use if he loses his turn.

Advance Ahead Two Space card (4): Player moves forward two spaces.

Advance Ahead Four Space card (4): Player moves forward four spaces.

Move Back Two Spaces card (4): Player moves back two spaces.

Winner card (1): Player that selects this card moves to the winner circle and is the winner of the game.

The following basic game rules apply to the board game. All players put their markers at the feet to start the game. The youngest player goes first and play continues to the oldest player. The cards are shuffled. The first player picks a card. That player must move his marker to whatever letter, shape, or number and combination he chooses. If the player goes to the wrong letter, shape or number he must move back to where he was and he loses a turn. He may, however, use a free turn card and take another turn or save it for later and miss his next turn. If a player picks a feet card he must go back to the beginning start area. To win the game a player must pick the Winner card.

The Math game for ages five and up is played with the numbers game. To begin, all players put their markers at the feet. The youngest player goes first and play continues to the oldest player. The cards are shuffled. The first player picks a flash card. The player must figure out the answer and must move to the correct number. If the player moves to the wrong answer then that player loses a turn. He may, however, use a free turn card and take another turn or save it for later and miss his next turn. If a player picks a feet card he must go back to the beginning start area. To win the game a player must pick the Winner card.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. New and improved games for teaching alphabet, numbers, colors, shapes and math along with coordination and motor skills comprising, in combination:

a planar member having a primary circle at its central interior and having a plurality of concentric rings located therearound to define a plurality of circular zones of increasing diameter when measured from the center, the zones having radially extending lines therethrough at least some of which are offset from each other in the various rings to define segments with indicia marked in each of the segments, two of such lines oriented in a cross-shaped configuration extending through the primary circle to define four separate start areas; and a deck of cards, each of the cards being provided with a first face which is blank and a second face with varying indicia thereon, the indicia of the cards being correlated to the indicia of the planar surface whereby, when a player standing in the circle picks a preselected card, such player will be required to move to a segment in response to the information on the card.

2. Games for teaching alphabet, numbers, color, shapes and math along with coordination and motor skills comprising:

a planar member having a circle at its central interior and having circles therearound to define a plurality of zones around the center, the zones having radially extending lines therethrough, at least some of which are offset from each other to define segments with indicia marked in each of the segments, two of such lines oriented in a cross-shaped configuration extending through the primary circle to define four separate start areas; and a plurality of indicia correlated to the indicia of the planar member, such plurality of indicia being randomly selectable by the players.

3. The apparatus as set forth in claim 2 wherein the plurality of indicia is a deck of cards, each of the cards being provided with a first face which is blank and a second face with varying indicia thereon, the indicia of the cards being correlated to the indicia of the planar surface whereby, when a player standing in the circle picks a preselected card, such player will be required to move to a segment in response to the information on the card.

4. The apparatus as set forth in claim 2 wherein the plurality of indicia is a spinner with a center and having indicia around its external periphery and an arrow rotatable about the center for pointing to a particular item of indicia to indicate an area of the platform wherein the player is to move.

5. The apparatus as set forth in claim 2 wherein the indicia is letters.

6. The apparatus as set forth in claim 2 wherein the indicia is numbers.

7. The apparatus as set forth in claim 2 wherein the indicia is a geometric figure.

8. The apparatus as set forth in claim 2 wherein the indicia on the card is an arithmetic equation correlated to numerical indicia on the card.

9. The apparatus as set forth in claim 2 wherein the curves form concentric rings.

* * * * *